United States Patent [19]

Kopp

[11] 4,113,298

[45] Sep. 12, 1978

[54] LIFTING CLAMP AND SPRING THEREFOR

[75] Inventor: Valentine T. Kopp, Lynbrook, N.Y.

[73] Assignee: Merrill Brothers, Maspeth, N.Y.

[21] Appl. No.: 710,736

[22] Filed: Aug. 2, 1976

[51] Int. Cl.[2] ..... B66C 1/48

[52] U.S. Cl. ..... 294/104; 294/101; 267/158

[58] Field of Search ..... 294/104, 101, 103 R, 294/DIG. 1; 267/158, 165, 154, 164, 156; 42/50

[56] References Cited

U.S. PATENT DOCUMENTS

| | | | |
|---|---|---|---|
| 1,958,778 | 5/1934 | Balduf | 267/165 |
| 2,937,866 | 5/1960 | Rogerson | 267/156 |
| 3,071,406 | 1/1963 | Lacker, Jr. | 294/104 |
| 3,254,884 | 6/1966 | Long et al. | 267/158 |
| 3,336,068 | 8/1967 | Renfroe | 294/101 |
| 3,370,881 | 2/1968 | Renfroe | 294/101 |
| 3,659,890 | 5/1972 | Renfroe | 294/104 |

*Primary Examiner*—James B. Marbert
*Attorney, Agent, or Firm*—Pennie & Edmonds

[57] ABSTRACT

A locking type of lifting clamp for lifting steel plates is disclosed in which there is provided the usual clamp body with a pivoted gripping cam pivotally mounted to extend across a slot into and out of engagement with a steel plate to be lifted. This cam is operated by a connecting link pivoted at one end to the cam and at the other end to a radius link which is itself pivoted to the clamp body. Pivoted to one end of the radius link is the lifting link which connects the same with the lifting shackles of a crane or the like. An operating lever is also pivoted to the clamp body and connected to the radius link by means of a combination link - spring pivoted at one end to the operating lever and at the other end to the radius link. The combination link - spring comprises a two part member made from spring steel bent into a generally double "Z" shape and in which the two parts are identical and nested together.

12 Claims, 8 Drawing Figures

LIFTING CLAMP AND SPRING THEREFOR

BACKGROUND OF THE INVENTION

This invention comprises improvements in known types of steel plate lifting clamps and in particular is an improvement over the steel lifting clamps of U.S. Pat. Nos. 3,441,308, 2,852,300 and 3,857,600.

THE PRIOR ART

In U.S. Pat. No. 3,441,308 a steel plate lifting clamp is disclosed in which the cam bears against a plate to be lifted and grips the same between the cam and a facing pad on a facing jaw. The cam is operated by means of a bell crank pivoted at the juncture of the two arms thereof to a radius link and also pivoted at the end of one of its arms to the gripping cam. The other and shorter arm of the bell crank is also pivoted to a special spring mechanism which in turn is pivoted at its other end to an operating lever. The operating lever is pivoted to the clamp body. The aforementioned spring mechanism is quite complicated and incorporates a pair of expander links arranged in juxtaposed and sliding relationship with the upper end of one of said links being pivoted to the short arm of the bell crank and the lower end of the other of said links being pivoted to the operating lever. A spring surrounds the two expander links and operates through shoulders surrounding the links to bring pressure against the links in varying degrees, depending upon the position of the operating lever and the position of the cam as determined by the thickness of the steel plate to be lifted.

Because of this special spring mechanism, the cam may be locked in the clamping position or it may be locked in the open position. The position of the cam in these instances being determined by the position of the operating lever. Additionally, the operating lever may be placed in a neutral or "stabilized" position in which the cam is on but not locked in on position and is, therefore, susceptable to being closed tightly against a plate by operation of the lifting link.

In later commerical embodiments of this clamp, the mechanism was somewhat modified and such clamp is shown in U.S. Pat. No. 3,507,534. Instead of two expander links the spring mechanism of this commerical clamp utilizes a casing pivoted at its upper end to the radius link and an internal rod pivoted at its lower end to the operating lever. A spring within the casing surrounds the rod and bears at its bottom end against the casing bottom and at its upper end against an abutment threaded onto the internal rod. The spring, therefore, tends to urge the outer casing downward into engagement with a cam surface integral with the operating lever.

In the above mentioned mechanisms, it is possible for the cam to jam in its clamped position against a steel plate after having lifted the same. This particularly occurs after having lifted plates of a thickness at or near the maximum thickness capacity for the particular clamp. This occurs even after the weight has been removed from the clamp and the lifting cable slackens. When so jammed, the cam cannot be released by the operating lever as intended, but first a light or moderate blow must be struck on the end of the lifting or "G" link in order to first free the cam from its jammed condition. Frequently, operators of the clamps will attempt to open such a jammed clamp by striking the operating lever with a hammer or other implement in an effort to move the operating lever to its open position. Such results in damage to either or both of the operating lever or the spring mechanism. This occurs due to the fact that the operating lever in its locked and clamped position or locked on position has passed over center and the additional fact that when lifting plates at and near the maximum thickness capacity for the clamp, the spring is under its maximum compression. Even at the greatest thickness which the clamp can accommodate, there is some compressibility still left in the spring and thus the operating lever may pass over center into its locked on position. When passing over center, the spring is further compressed and then a small amount of the compression is released once the operating lever is in its locked on position. When the crane then lifts the clamp and the plate, the weight of the plate further pivots the gripping cam into still a tighter gripping position; however, this movement compresses the spring still further. When then the plate is set down and the weight removed from the clamp, there is not sufficient compressibility remaining in the spring to permit the operating lever to compress it even the slight amount necessary to pass back over center to the open position. In these clamps the spring is always under some compression, even in its least compressed state. The compression of the spring holds the operating lever in both its locked on and locked open positions.

SUMMARY OF THE INVENTION

The present invention retains the safety features of the prior art clamp while overcoming the possibility of the clamp becoming jammed in its locked on position in such a manner as to prevent the operating lever from being moved to its open position. The present invention also simplifies the prior art devices by using fewer parts of unique design.

To accomplish these ends, the device of the present invention replaces the former spring mechanism with a combination link-spring of novel design. The combination link-spring is pivoted at one end to the radius link and at the other end to the operating lever. Since this combination link-spring is pivoted as mentioned, movement of either the operating lever or the radius link will be transmitted to the spring which, in turn, will either move the other member or absorb the movement within the spring itself or a combination of both, depending upon the relative positions of the parts when the movement is initiated and during such movements.

In particular, the combination link-spring is comprised of two pieces of spring steel ribbon each of which is bent to form a loop at either end and with at least two oppositely directed intermediate bends. These two pieces are then nested together to provide the link-spring which receives a pivot pin on the radius link at one end thereof and a pin on the operating lever at the other end. Intermediate its ends, this composite spring has at least two opposite bends therein to give it a generally "Z" shape. In the preferred embodiment, there are two pairs of oppositely directed intermediate bends giving the preferred spring the appearance of a double "Z".

Because the combination link-spring is pivoted at one end to the radius link and at the other end to the operating lever, the movement of either the radius link or the operating lever will be imparted to the link-spring. The combination link-spring will, in turn, impart none, part, or all of such received movement to the other element. To the extent that the movement of one or the other of the radius link and the operating lever is not wholly imparted to the other thereof, the movement is absorbed by the link-spring, either by compression of the spring or extension and tensioning thereof. Whether none, part, or all of the movement of the radius link or the operating lever is imparted to the other thereof depends upon the relative position of the members at the time of such movement and their design relationship.

DESCRIPTION OF THE PREFERRED EMBODIMENT

Figure 1:
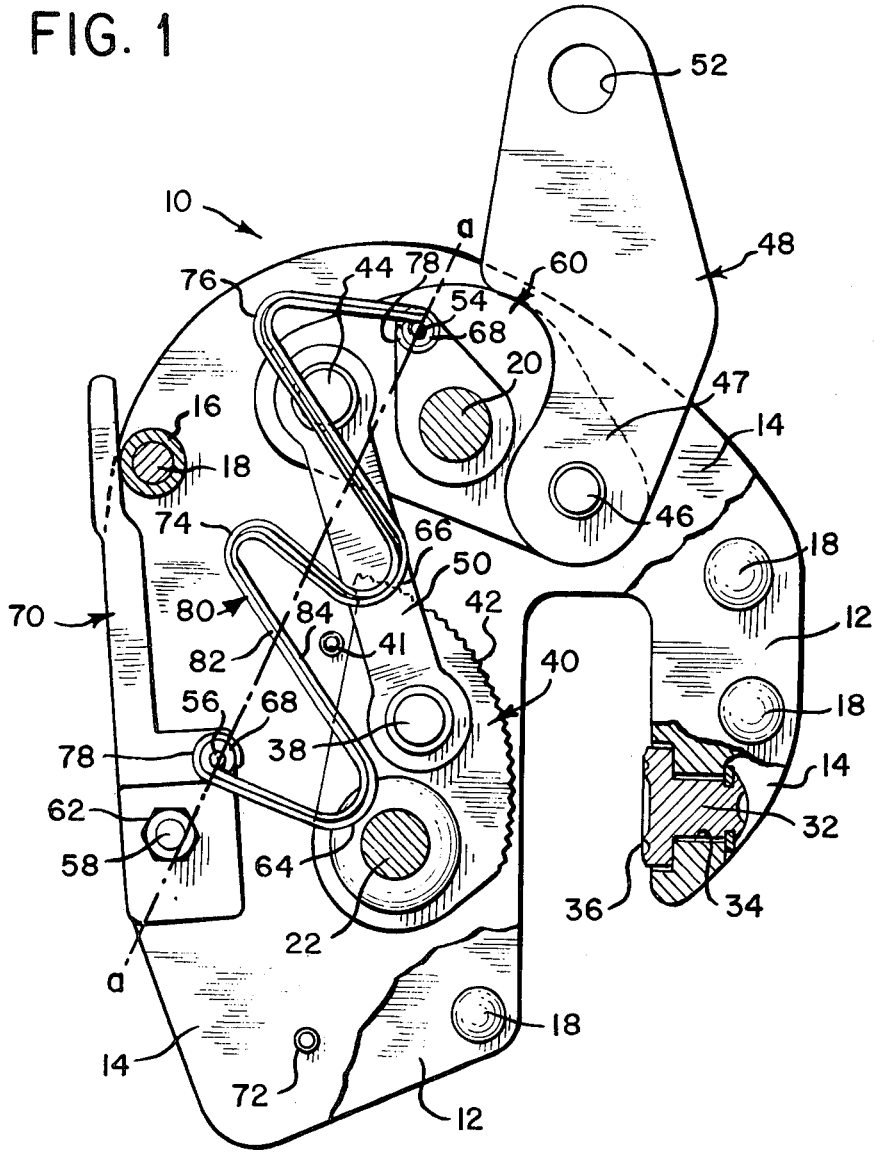
FIG. 1 is a side elevation of the clamp of this invention with portions of the housing plate broken away to show the operating mechanism which in this view is in its locked open position.

Referring to the figures, FIG. 1 shows a lifting clamp generally indicated at 10 comprised of a two part housing, the two parts of which are facing and matching plates 12 and 14. As shown in FIG. 1, the plate 12 has been broken away to show the operating elements of the device. The two plates 12 and 14 are held in spaced apart condition by means of embossments 16 on each plate extending half way to the other plate and there bearing against a mating embossment as perhaps best shown in FIG. 3. Rivets 18 pass through these embossments 16 and hold the two plates 12, 14 in fixed spaced apart relationship to form a housing. It will be appreciated that the rivets have enlarged ends and the preferred type of securement is a conventional button head rivet although bolts or the like could also be used.

Figure 3:
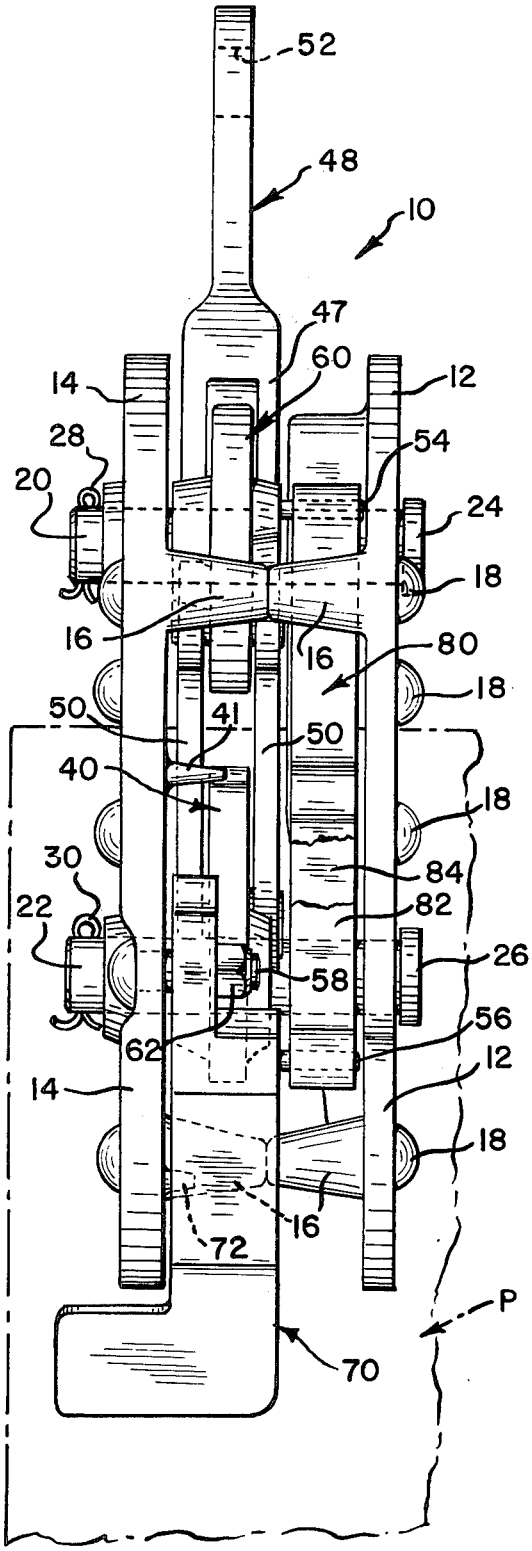
FIG. 3 is an end elevation taken in the direction of the arrow A of FIG. 2.

Fixed pivot shafts 20 and 22 also pass through the plates 12 and 14 of the housing and have enlarged heads 24 and 26 respectively bearing against the outside surface of the plate 14 as best shown in FIG. 3 and have cotter pins 28 and 30 respectively passing through said shafts 20 and 22 and bearing against the outside face of the plate 14. Thus the shafts 20 and 22 also aid in maintaining the plates 12 and 14 secured together.

Figure 2:
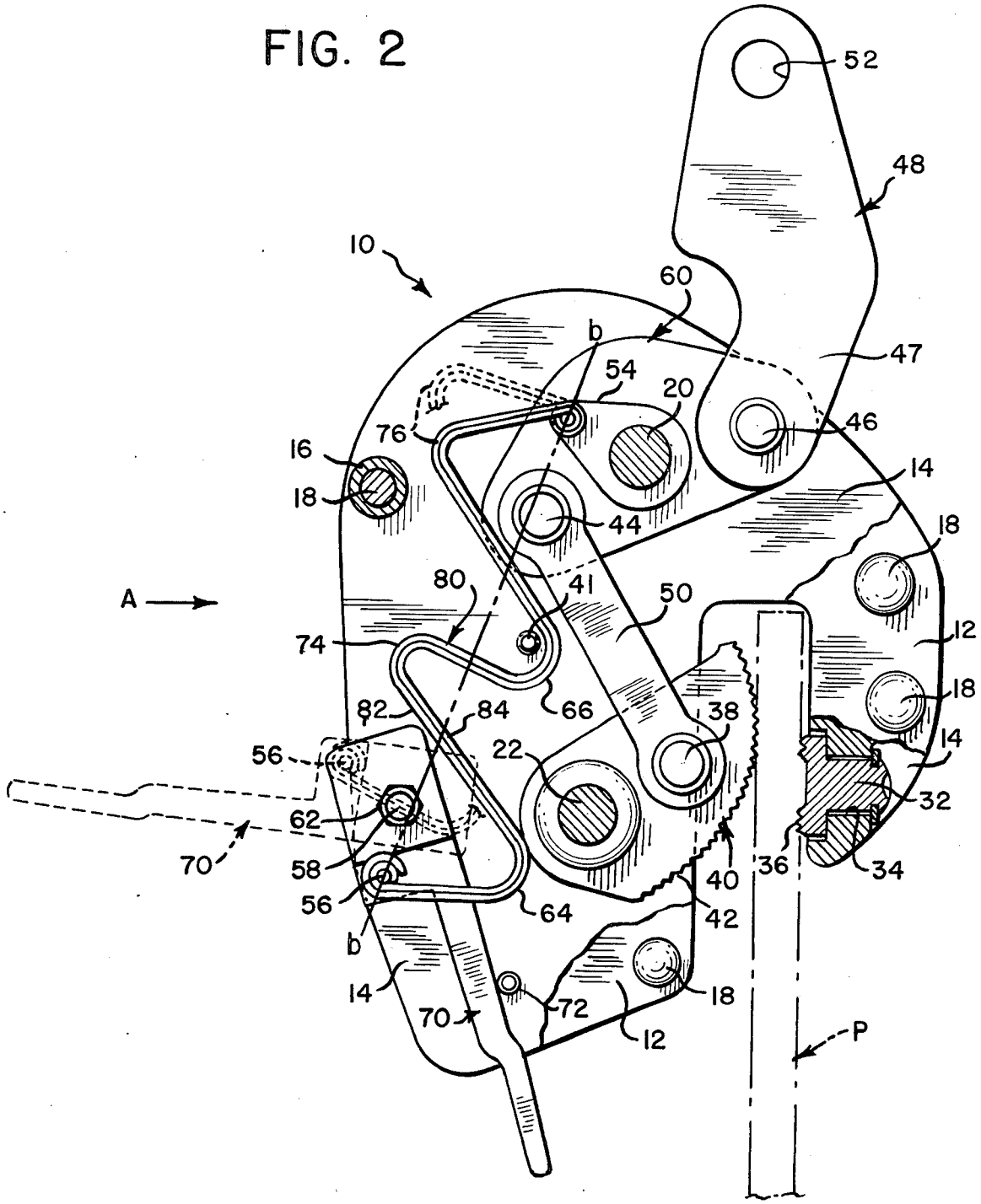
FIG. 2 is a view similar to FIG. 1 with the device in its locked on position shown in solid lines and its on but not locked position in broken lines.

The lifting clamp has the shape generally of an inverted "U" when in use and as shown in FIGS. 1 and 2. The shorter arm of the "U" has mounted therein a pad 32 of known type mounted somewhat loosely in the opening 34 of the shorter arm or jaw in known manner. It will be appreciated that one half of the opening 34 is formed in each of the facing plates 12 and 14 thus completing a generally cylindrical opening when the two plates are matched together. The pad 32 has ridges 36 on its face as is also known.

Pivotally mounted on the shaft 22 in the space between the facing plates 12 and 14 is a gripping cam 40 having a serrated cam shaped face 42 of generally conventional shape. Pivoted on either side of the cam 40 at 38 are a pair of connecting links 50 which are pivoted at their other ends at 44 on either side of a radius link 60 which in turn is pivotally mounted between the facing plates 12 and 14 on the fixed pivot shaft 20 for pivotal movement thereabout. Also pivoted on either side of the radius link 60 at 46 are the legs 47 of a bifurcated lifting link 48. As shown, the lifting link 48 is a chain connector having an opening 52 therein through which a pin (not shown) may be passed for connecting the chain connector 48 to the end of a length of chain suspended from above as from a crane. However, the lifting link 48 may be a shackle with an eye to receive a hoist hook or any other suitable connecting means.

An operating lever 70 is also mounted between the plates 12 and 14 on a fixed pivot 58 which may be a rivet or, as shown, a bolt 58 passing through an opening in the lever 70 and also through an opening in the wall 14 of the housing and having a nut 62 thereon.

THE SPRING

A double link-spring 80 is pivotally mounted at 56 to the lever 70 and at its other end at 54, to the radius link 60. As shown, the spring 80 comprises two nested parts 82 and 84 which are identical pieces of flat ribbon spring steel bent to the shape shown. When nested as shown in FIGS. 1 and 2, the two springs have two bends 64 and 66 opening generally to the left in the figures and two bends 74 and 76 opening generally to the right. The elements 82 and 84 of the combined link-spring 80 each have a small loop 68 at one end and a larger loop 78 at their other end. It will be noted that the larger loop 78 does not quite close, since it must receive the thickness of the other half of the spring.

Figure 4:
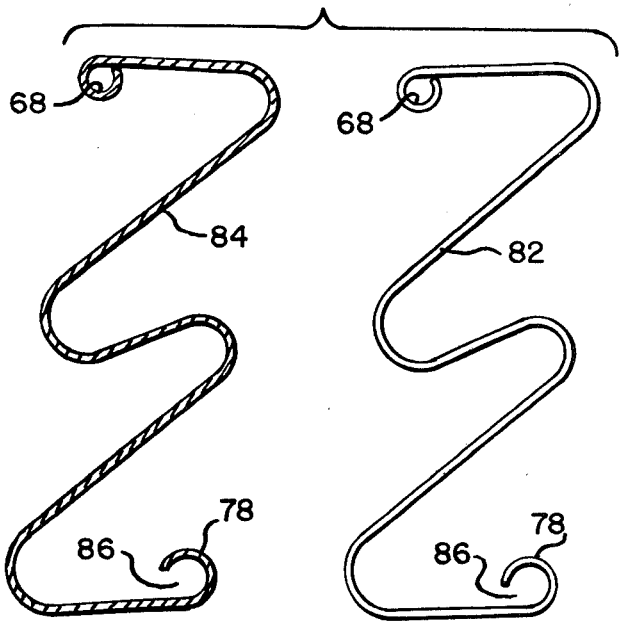
FIG. 4 shows the two parts of the combination link-spring used in the device of FIGS. 1–3 removed from the device and positioned beside each other in unnested condition.
Figure 5:
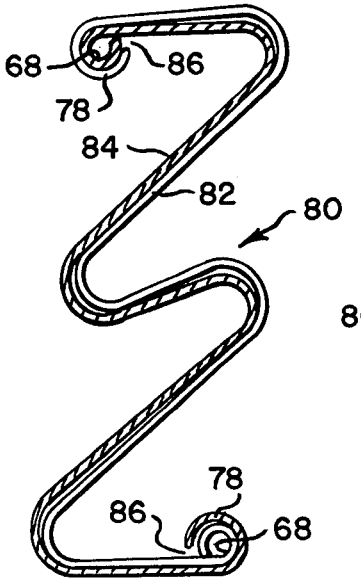
FIG. 5 shows the two parts of the link-spring and how they are nested together.
Figure 6:
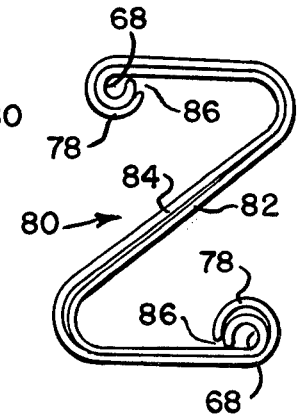
FIG. 6 is a modification of the spring of FIGS. 1–5.

The spring details are perhaps best shown in FIGS. 4 and 5. As shown in FIG. 4, the spring 80 comprises two identical parts 82 and 84 which are not nested together in the figure. As shown in the figure, the two halves 82 and 84, rest beside each other in the same orientation, i.e., both have their small loop 68 at the top and facing to the left. It is apparent from the figure that both members, 82 and 84, are identical in shape and size. As will also be seen from the figure, the small loop 68 is substantially closed, although it need not be. The large loop 78; however, must be spaced with the gap 86 in order to receive the thickness of the other spring. In the orientation shown in FIG. 4, the springs will not nest. However, if one of them (say the one on the right) is rotated 180° in the plane of the drawing to bring its small loop to the bottom and its large to the top, then one of them may be lifted and placed on top of the other one and the two pieces nested as shown in FIG. 5. For convenience in visualizing this nesting in FIGS. 4 and 5 the spring 84 is shown cross-hatched while the spring 82 is not. It will also be seen from FIG. 5 that the springs comprise a generally double "Z" in shape with the upper bar of the lower "Z" being the bottom bar of the upper "Z". It will also be appreciated that the spring 80 may be longer or shorter by addition of additional bends or the use of fewer thereof. While the spring of FIGS. 1–5 has two bends opening in one direction and two bends opening in the opposite direction, the spring of FIG. 6 has only two bends with one opening in each of two opposite directions.

OPERATION

Having reference to FIGS. 1 and 2, FIG. 1 shows the clamp in its "locked open" position, i.e., in this position, it will not clamp anything placed in the slot between and pad 32 and the gripper cam 40 even if the weight of the clamp is on the chain connector 48 as when hanging from a crane's cable or chain. As shown, the operating lever 70 has been moved to "over center". That is that a line *a—a* drawn between the axis of the pivot 54 and the axis of the pivot 56 falls to one side (the right in FIG. 1) of the axis of the bolt 58 about which the lever 70 pivots. In the position shown in FIG. 1, the pivot points 54 and 56 are closer together than at any other time during normal operation (except when passing "over center" to the position shown) and the spring 80 is, accordingly, under compression. This compression tends to try to rotate the lever 70 in the clockwise direction as shown in FIG. 1 due to the position of line *a—a* with respect to the axis of pivot 58, but further movement clockwise is prevented by the abutment of the end of the lever 70 against a stop which, as shown, is one of the embossments 16 of the housing. In the opposite direction, the spring 80 tends to try to rotate the radius link 60 clockwise about the pivot 20, but it is prevented from doing so due to the fact that the axis of the pivots 54 and 20 are close together and as such the mechanical advantage is slight. Of course, alignment of the pivots 44, 38 and 22 represents the apparent theoretical geometric limit of clockwise rotation of the radius link 60. However, such condition is to be avoided lest upon release from the locked open position the link turn the cam the wrong way. A stop 41 is provided to insure against such happening, but in the embodiment shown the moment of force exerted by spring 80 to move radius link 60 clockwise, while sufficient to move the several parts to or close to the position shown, is not normally sufficient to move them the last small increment necessary to bring the back of gripper cam 40 up against stop 41.

In the broken line position shown in FIG. 2, the lever is in its on or closed position, but it is not locked on. There are two safety features to this position. In this position, the operating lever 70 extends noticeably from the clamp and can be spotted even by a crane operator some distance away. He then knows that the clamp is not properly locked on. To aid in such observance, the end of the lever may be large and painted a bright color such as red or orange. A second safety feature of this position is that while the clamp is not locked on, it can still safely lift a plate since upward movement on the lifting link 48 rotates the radius link counerclockwise and the cam 40 clockwise into tight engagement with a plate between it and the pad 32. This occasionally happens when a plate is being lifted from the horizontal position if the operator of the clamp is careless and does not properly lock the clamp in its locked position as shown in solid lines in FIG. 2.

As shown in FIG. 2, the lever 70 has been moved counterclockwise from its position of FIG. 1 through the broken line position shown in FIG. 2 to the solid line position of FIG. 2 where it bears against a stop 72 extending inwardly from the housing plate 14. Again, the lever 70 has moved "over center" in which a line *b—b* drawn between the axes of pivots 54 and 56 lies to the right of the axis of bolt 58. In this position, however, the spring is in tension and tends to try to move the lever 70 counterclockwise due to the position of line *b—b* with respect to the axis of bolt 58, thus holding it against the stop 72. This tension also tends to try to rotate the radius link 60 in a counterclockwise direction, thus imparting through the connecting link 50 a clockwise movement to the cam 40 thus tending to make it bear against any plate P positioned between the cam 40 and the pad 32. Accordingly, when the clamp and operating lever are in their locked open position as in FIG. 1, the spring 80 is under compression, when the parts are in their on but not locked condition shown in broken lines in FIG. 2 the spring is under neither compression nor tension and when the parts are in their locked on position as shown in solid lines in FIG. 2 the spring is under tension. It should also be noted that lifting through the lifting link 48 upwardly even with a maximum load, (i.e., a plate of maximum thickness), tends to slightly reduce the tension in the spring 80 and, accordingly, after such a lifting the slight additional tension created when moving the lever 70 clockwise out of its locked on position is readily achieved as it passes over center (the axis of the bolt 58) to release the gripper cam and the plate which had been lifted. Accordlingly, while it is possible when lifting a plate of maximum thickness for the gripper cam 40 to be tightened to such an extent that the operating lever 70 cannot release the cam 40 from the plate P, the operating lever 70, in such a situation, can nevertheless be easily moved out of the locked on position to the neutral position and to the locked open position. Thus the operator will not be tempted to strike on the operating lever to vainly try to release it as was priviously the case.

Also, when the gripper cam does tighten up as just described the operating lever 70 can be moved to the locked open position in which the link-spring 80 will then be severly compressed. In this position the link-spring 80 is exerting a force counterclockwise (in FIGS. 1 and 2) in an effort to open the gripper cam 40. The clamp 10 need then be merely shaken or jiggled or the casing struck a light blot to release the cam's bite on the plate. Previously, when this occurred the operating lever was jammed as well and the spring mechanism exerted pressure tending to hold the gripper cam against the plate.

When in the present device such jamming occurs and the operating lever is moved to the locked open position the link-spring 80 is, as mentioned, severely compressed. When then the clamp is jiggled to break the bite of cam 40 on a Plate P, then the spring returns the linkage and cam to locked open position with considerable force. If the parts are worn there is danger that the parts will "overtoggle" i.e. move to a position where the axis of pivot 38 is on the other side (to the left in FIG. 1) of a line drawn between the axes of pivots 22 and 44. To prevent this from occurring the stop 41 is provided.

CLAMP MODIFICATION

Figure 7:
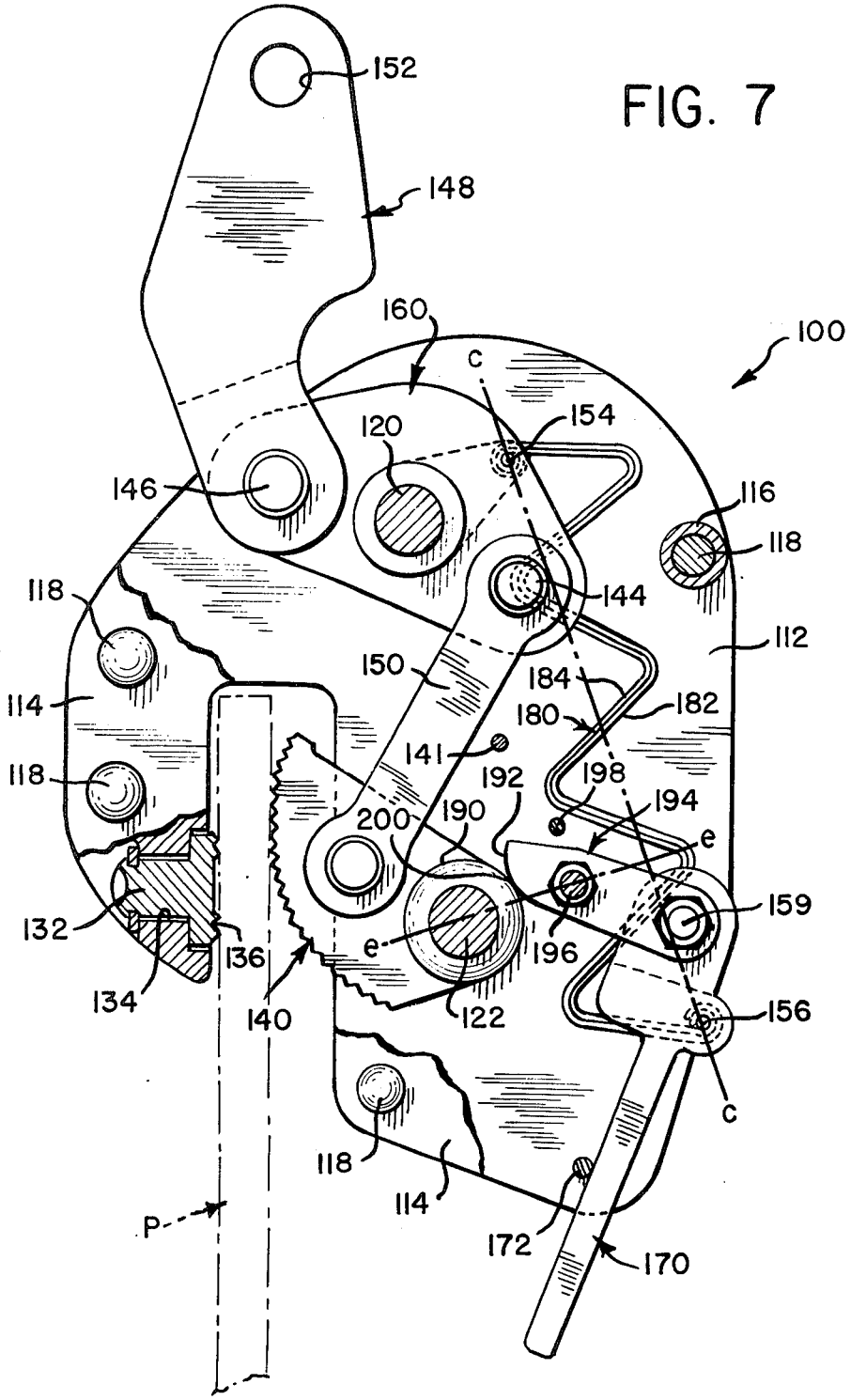
FIG. 7 is a modification of the clamp of FIGS. 1–3 using the novel spring of this invention and shown in locked on position.

In FIG. 7 is shown a modified clamp similar to that of FIGS. 1–3 which utilizes a cam arrangement to hold the gripper cam in engagement with a steel plate being lifted and against possible opening when the weight of the plate is removed from the clamp as when the plate is set down upon the floor or other support. While the preferred embodiment of FIGS. 1–3 accomplishes the same purpose in its locked on position due to the tension of the link-spring 80, the invention is also applicable to clamps disclosed in the prior art which use a cam arrangement for this purpose. U.S. Pat. Nos. 2,852,300 and 3,857,600 disclose clamps which use cams to lock the gripper cam in contact with a plate.

In FIG. 7, parts which are substantially identical to or are analagous to like parts in the embodiment of FIGS. 1–3 are numbered with the same numerals with the prefix 1. That is to say by adding 100 thereto. The link-spring 180, for example, is like the link-spring 80 of FIGS. 1–3 excepting that it has 3 pairs of bends with one bend of each pair facing in one direction and the other bend of each pair facing in the opposite direction. Accordingly, there are six bends with three facing to the left in FIG. 7 and three facing to the right.

The structure of the modified clamp of FIG. 7 is much like that of the FIGS. 1–3 embodiment excepting that in the FIG. 7 clamp there is a cam means arranged between the operating lever 170 and the gripping cam 140. The gripping cam 140 has on a hub thereof a cam surface 190 that is circular and concentric to the axis of the shaft 122 about which the gripper cam 140 pivots. Cooperating with the cam surface 190 is an arcuate cam surface 192 on a pivoted cam 194 pivoted at 196 on a suitable fixed pivot such as a bolt passing through the faceplate 114 (the broken away faceplate closest to the viewer in FIG. 7). Adjacent its other end cam 194 is pivoted at 159 to operating lever 170 by any suitable means such as the bolt and nut shown. This pivot 159 serves as a "floating pivot" in that it can move about the axis of pivot 196. As shown in FIG. 7, the operating lever 170 is against a stop 172 and is held in that position by virtue of the fact that the link spring 180 is tensioned and a line *c—c* drawn between the pivot points 154 and 156 lies to one side (to the left as viewed in FIG. 7) of the floating pivot 159. Thus, the operating lever 170 is being held against the stop 172 by the tension in the spring 180. The link-spring 180 is also applying a force to cam 194 in a counterclockwise direction but the cam cannot rotate due to engagement of cam surface 192 with cam 190. The clamp is in its locked on position.

Figure 8:
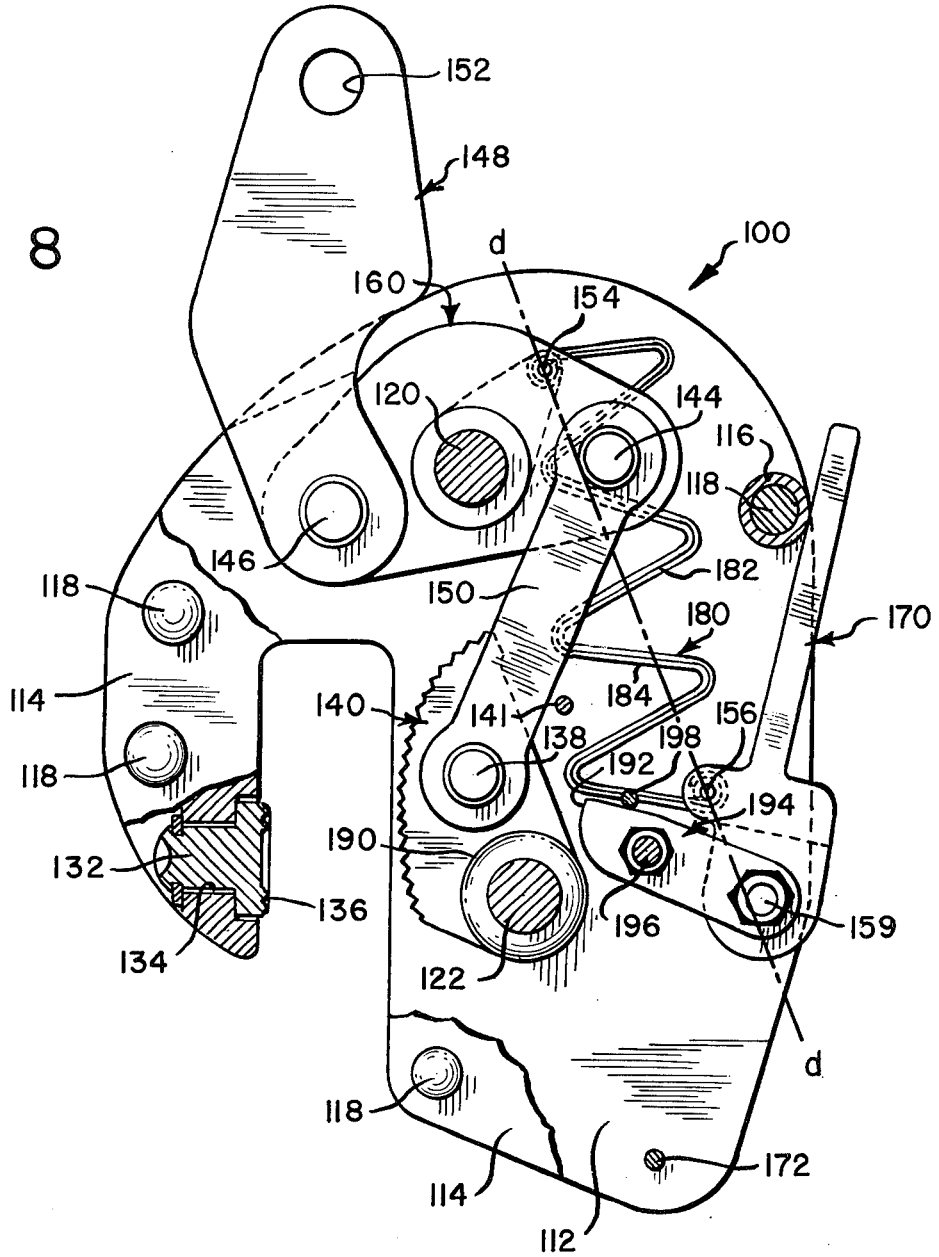
FIG. 8 is the clamp of FIG. 7 shown in locked open position.

In this position of the parts, the point 200 where the cam surfaces 190 and 192 contact, is above a line *e—e* drawn between the axes of the pivots 122 and 196. The arcuate surface of the cam 192 is chosen to ensure that the point 200 where the two cam surfaces 190 and 192 are in contact is always above the line *e—e* regardless of the thickness of the plate P being gripped. Because of this position, any attempted clockwise rotation of the gripper cam 140 about its pivot shaft 122 is prevented even when the plate is set down. Accordingly, the gripper cam 140 is fixed against the plate in gripping fashion until such time as the operating lever 170 is rotated counterclockwise about its pivot 159. When this occurs there is a force applied both by spring link 180 and the operator to rotate the cam 194 counterclockwise as well, but since the cam surface 192 is bearing on cam surface 190 the rotation of cam 194 is prevented. As such, the only motion possible is for operating lever 170 to rotate counterclockwise about its pivot 159 which is for the time being essentially fixed. As this movement continues, however, a point is reached where the axes of pivots 196, 159, and 156 all lie on the same line and at about this point or soon thereafter the link-spring 180 is in a neutral position being neither compressed nor tensioned. Further counterclockwise movement of operating lever 170 by the operator soon brings the pivot 156 to a point where a line drawn between its axis and the axis of pivot 196 lies above pivot 159 at about this point or soon thereafter the link-spring 180 begins to resist further counterclockwise movement of the operating lever 170. At this point the pivot 156 serves substantially as a fixed pivot and counterclockwise movement of the operating lever 170 imparts a downward movement to pivot 159 and a clockwise rotation to the cam 194. This rotation causes cam 194 to release the gripper cam 140 and come up against the stop 198 and thus the pivot 159 is again temporarily fixed but this time in the position of FIG. 8. The continued counterclockwise rotational movement of operating lever 170 by the operator compresses the link-spring 180 thus applying a counterclockwise rotation to the radius link 160 and through it and links 150 a clockwise force to the gripper cam 140 moving it out of engagement with a plate positioned in the clamp. The final movement of lever 170 counterclockwise brings the lever 170 against the stop 116 and so positions the pivot 156 that the line *d—d* drawn through it and pivot 154 lies to the left of the axis of pivot 159. This position is shown in FIG. 8. In this position the link-spring is applying a force to lever 170 counterclockwise about pivot 159 but movement is prevented by stop 116. The link-spring is also applying a force clockwise to the cam 194 but movement is prevented by stop 198. The compression force in the link-spring 180 is also trying to rotate the radius link 160 counterclockwise and the gripper cam 140 clockwise but these have either reached the limit normally obtainable or the back of cam 140 has come up against stop 141. The clamp is in its locked open position.

When the operator moves the operating lever 170 clockwise to apply the clamp to a plate the lever 170 initially pivots about the temporarily fixed pivot 159. This moves pivot 156 clockwise about pivot 159 and thus moves line *d—d* to the right to a point where the lever 170 has again moved over center and the line *d—d* lies to the upper right of pivot 159. Further clockwise rotation of lever 170 decreases the compression in the link-spring steadily until it is under neither compression nor tension. Shortly thereafter the link-spring 180 begins to resist further rotation of the operating lever 170. As this resistance begins further rotation of operating lever 170 does two things. First, it applies an upward force on pivot 159 and thus a rotational force is applied to cam 194 tending to rotate cam 194 counterclockwise. Second, the tension applied through link-spring 180 tends to rotate radius link 160 clockwise and thus through links 150 a counterclockwise force is applied to gripper cam 140. Both of these two sets of motions begin substantially simultaneously, but very little movement of cam 194 is required and very little force is necessary to complete its rotation. As such the cam 194 will complete its rotation very quickly thus bringing cam surface 192 into engagement with cam surface 190 well before gripper cam 140 has completed its rotation into engagement with a plate.

Once cam 194 has moved to engage cam surface 190 the pivot 159 is again temporarily fixed in the position of FIG. 7. Continued clockwise movement of operating lever 170 by the operator then continues to move radius link 160 clockwise and through links 150 the gripper cam 140 continues to move counterclockwise until it engages a plate. Further clockwise rotation of lever 170 by the operator applies tension to link-spring 180 which in turn applies clockwise rotational force to radius link 160 and thus applying force to hold gripper cam 140 tightly against the plate. The final movement brings all of the parts to the position shown in FIG. 7 with the link-spring 180 in tension and the pivot 159 lying to the right of line *c—c* and lever 170 up against stop 172 as above described. The clamp is in its locked on position.

It will be appreciated by those skilled in the art that in the embodiment of FIGS. 7 and 8 the gripper cam 140 is held in engagement with a plate not only by the tension in link-spring 180 as in the case with the embodiment of FIGS. 1–3, but also is locked in place by the cam 194. Any action tending to rotate gripper cam 140 clockwise out of engagement with a plate such as when the plate is set down will try to rotate cam 194 counterclockwise but due to the arcuate shape of cam surface 192 such a force only causes cam 194 to bear even harder against cam surface 190. The force is transmitted to and resisted by the fixed pivots 122 and 196.

It will be understood by those skilled in the art that the modification shown in FIGS. 7 and 8 is particularly useful for clamps designed for lifting very heavy plates of, say, 2 to 5 tons or more. In such cases it may prove difficult to design a Z spring that would have enough force in tension to adequately hold the gripper cam in engagement with a plate while still being capable of manual operation by the operator to move the operating lever to and from the locked on and locked open positions. In such event the modification of FIGS. 7 and 8 provides the added holding strength of the cam 194 to insure a tight grip without requiring an excessively powerful spring.

I claim:

1. In a clamp of the type used for lifting steel plates including a pair of opposed jaws, said jaws facing each other across a plate-receiving space, one of said jaws being substantially fixed, the other of said jaws being movable across said space toward and away from said fixed jaw to grip a plate positioned therebetween, linkage means for moving said movable jaw into a locked on position in engagement with a plate in said space and out of said locked on position and into a locked open position in which said movable jaw is locked in a position out of contact with any plate in said space, said linkage means being such that when the weight of said plate is on said clamp the weight thereof tends to cause said movable jaw to move into tighter gripping engagement with the plate, and an operating lever for selectively moving said linkage means into and out of said locked on and locked open position, the improvement comprising:

(a) a combination link-spring pivoted at one end to said operating lever and at the other end to said linkage means, (b) said link-spring when said lever is in said locked open position being under compression, (c) when said lever is in said locked on position said link-spring being under tension and, (d) said operating lever during at least the latter portion of its movement from the locked on to the locked open position exerting a compressive force through said link-spring to said linkage means to move the same to the locked open position.

2. The clamp according to claim 1 in which said linkage means includes a lifting link, and in which said operating lever is movable to an intermediate position in which the linkage means and the movable jaw are neither locked on nor locked open, said movable jaw when in said intermediate position being susceptible to movement into lifting engagement with said plate upon lifting on said lifting link.

3. The clamp of claim 2 in which when said operating lever is in said intermediate position said link-spring is under neither compression nor tension.

4. A spring comprising at least two pieces of bent spring steel ribbon, each of said pieces being bent to substantially the same shape and size, each of said pieces having at least one bend in a direction substantially opposite to said first direction, and said two pieces being nested together to function substantially as a single spring.

5. The spring of claim 4 in which each of said pieces has a relatively smaller loop on one end and a relatively larger loop on the other end, and each of said pieces when in nested condition having its smaller loop positioned within the larger loop of the other said pieces.

6. The spring of claim 5 in which each of said pieces has a plurality of bends in said first direction and a number of bends in said opposite direction equal in number to the plurality in said first direction.

7. The clamp of claim 1 including cam means positioned between said operating lever and said movable jaw for additional locking of said movable jaw against a plate when the operating lever is in the locked on position.

8. The clamp of claim 7 in which said cam means includes a first cam surface on said movable jaw and a second cam surface movable into and out of engagement with said first cam surface upon operation of said operating lever.

9. The clamp of claim 8 in which when said operating lever is in locked on position said first and second cam surfaces are in engagement.

10. The clamp of claim 8 in which said second cam suface is on a cam pivoted to said operating lever.

11. The clamp of claim 10 in which the pivotal connection between said cam and said operating lever is a floating pivot.

12. The clamp of claim 11 in which said cam is also pivoted to a substantially fixed portion of said clamp.

* * * * *